US008763763B2

(12) United States Patent
Kawakami

(10) Patent No.: US 8,763,763 B2
(45) Date of Patent: Jul. 1, 2014

(54) ELEVATOR APPARATUS HAVING CAR POSITION DETECTION

(75) Inventor: Shigenobu Kawakami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 462 days.

(21) Appl. No.: 13/125,876

(22) PCT Filed: Dec. 11, 2008

(86) PCT No.: PCT/JP2008/072506

§ 371 (c)(1),
(2), (4) Date: Apr. 25, 2011

(87) PCT Pub. No.: WO2010/067435

PCT Pub. Date: Jun. 17, 2010

(65) Prior Publication Data

US 2011/0203878 A1 Aug. 25, 2011

(51) Int. Cl.
*B66B 1/34* (2006.01)

(52) U.S. Cl.
USPC ..... 187/393; 187/247

(58) Field of Classification Search
USPC ..... 187/247, 391–393
See application file for complete search history.

(56) References Cited

U.S. PATENT DOCUMENTS

| | | | | |
|---|---|---|---|---|
| 5,780,786 | A * | 7/1998 | Miyanishi | 187/293 |
| 5,861,084 | A * | 1/1999 | Barker et al. | 187/264 |
| 6,102,165 | A | 8/2000 | Wittur et al. | |
| 6,318,506 | B1 * | 11/2001 | Marte et al. | 187/373 |
| 6,454,054 | B1 * | 9/2002 | Tanino et al. | 187/394 |
| 7,353,916 | B2 * | 4/2008 | Angst | 187/393 |
| 8,316,996 | B2 * | 11/2012 | Hashimoto et al. | 187/288 |
| 2001/0040071 | A1 | 11/2001 | Sasaki | |
| 2002/0043433 | A1 | 4/2002 | Tanino et al. | |
| 2005/0269163 | A1 | 12/2005 | Angst | |
| 2012/0043166 | A1 * | 2/2012 | Washio et al. | 187/393 |
| 2012/0073909 | A1 * | 3/2012 | Kondo et al. | 187/247 |

FOREIGN PATENT DOCUMENTS

| | | | |
|---|---|---|---|
| JP | 56-48376 | A | 5/1981 |
| JP | 56-117969 | A | 9/1981 |
| JP | 58-26784 | A | 2/1983 |
| JP | 60 69270 | | 5/1985 |

(Continued)

OTHER PUBLICATIONS

Office Action issued Jun. 25, 2013 in Japanese Patent Application No. 2010-541926 (with English language translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

In an elevator apparatus, a speed governor is disposed in an upper portion of a hoistway, and a tensioning sheave is disposed in a lower portion of the hoistway. A speed governor rope that is moved in response to movement of a car is wound around a speed governor sheave of the speed governor and the tensioning sheave. The tensioning sheave is rotated in response to movement of the speed governor rope. A rotation detector that generates a signal that corresponds to rotation of the tensioning sheave is disposed on the tensioning sheave. Information from the rotation detector is sent to a controlling apparatus. The controlling apparatus detects a position of the car based on the information from the rotation detector.

3 Claims, 6 Drawing Sheets

(56) References Cited

FOREIGN PATENT DOCUMENTS

| | | |
|---|---|---|
| JP | 3 177283 | 8/1991 |
| JP | 6 144734 | 5/1994 |
| JP | 9 12245 | 1/1997 |
| JP | 2002 120977 | 4/2002 |
| JP | 2007 62948 | 3/2007 |
| JP | 2009 107809 | 5/2009 |

OTHER PUBLICATIONS

International Search Report issued Aug. 28, 2009 in PCT/JP08/072506 filed Dec. 11, 2008.

Supplemental European Search Report dated Apr. 14, 2014 in European Application No. 08878734.6.

* cited by examiner

ELEVATOR APPARATUS HAVING CAR POSITION DETECTION

TECHNICAL FIELD

The present invention relates to an elevator apparatus in which a speed governor rope that is moved in response to movement of a car is wound around a speed governor sheave and a tensioning sheave.

BACKGROUND ART

Conventionally, in order to detect a position of a car, elevators have been proposed in which a speed governor rope that is connected to the car is wound around a sheave of a speed governor, and a pulse generator that outputs a pulse signal that corresponds to rotation of the sheave of the speed governor is disposed on the speed governor. The speed governor is disposed in an upper portion of a hoistway. The position of the car is detected based on the pulse signal (see Patent Literature 1).

Conventionally, in order to detect a position of a car, elevators have also been proposed in which a transmitting sheave is pressed against a speed governor rope that is connected to the car, and an encoder that outputs a signal that corresponds to rotation of the transmitting sheave is disposed on the transmitting sheave. The speed governor rope is wound around a sheave of the speed governor that is disposed in an upper portion of a hoistway and a tensioning sheave that is disposed in a lower portion of the hoistway. The transmitting sheave is disposed in an intermediate portion of the hoistway. The position of the car is detected based on the signal from the encoder (see Patent Literature 2).

[Patent Literature 1]
Japanese Patent Laid-Open No. HEI 3-177283 (Gazette)
[Patent Literature 2]
Japanese Patent Laid-Open No. 2002-120977 (Gazette)

DISCLOSURE OF THE INVENTION

Problem to be Solved by the Invention

However, in the elevator that is disclosed in Patent Literature 1, if modification work is performed in order to improve controlling performance of an existing elevator, the speed governor may have to be updated together with the pulse generator because the pulse generator is integrated with the speed governor. In that case, if the manufacturing of the existing speed governor has already been completed, or the existing speed governor is embedded in a concrete floor, etc., then elevator modification work becomes time-consuming because work such as manufacturing a new speed governor, or breaking up the floor, etc., arises. If the existing speed governor is renewed, load on construction workers is further increased because it is necessary to pull the speed governor rope up into the upper portion of the hoistway and remove the speed governor rope from the speed governor.

In the elevator that is disclosed in Patent Literature 2, because the transmitting sheave and the encoder are disposed in an intermediate portion of the hoistway, workers that perform the modification work must perform the renewal work on the transmitting sheave and the encoder in an unstable state standing on the roof of the car. Consequently, elevator modification work for improving controlling performance is also time-consuming in this elevator.

The present invention aims to solve the above problems and an object of the present invention is to provide an elevator apparatus that enables modification work to be performed easily.

Means for Solving the Problem

In order to achieve the above object, according to one aspect of the present invention, there is provided an elevator apparatus characterized in including: a car that can be moved inside a hoistway; a speed governor that includes a speed governor sheave, and that is disposed in an upper portion of the hoistway; a speed governor rope that is wound around the speed governor sheave, and that is moved in response to movement of the car; a tensioning sheave that is disposed in a lower portion of the hoistway, around which the speed governor rope is wound, and that is rotated in response to movement of the speed governor rope; a rotation detector that is disposed on the tensioning sheave, and that generates a signal that corresponds to rotation of the tensioning sheave; and a controlling apparatus that detects a position of the car based on information from the rotation detector.

BEST MODE FOR CARRYING OUT THE INVENTION

Preferred embodiments of the present invention will now be explained with reference to the drawings.

Embodiment 1

Figure 1:
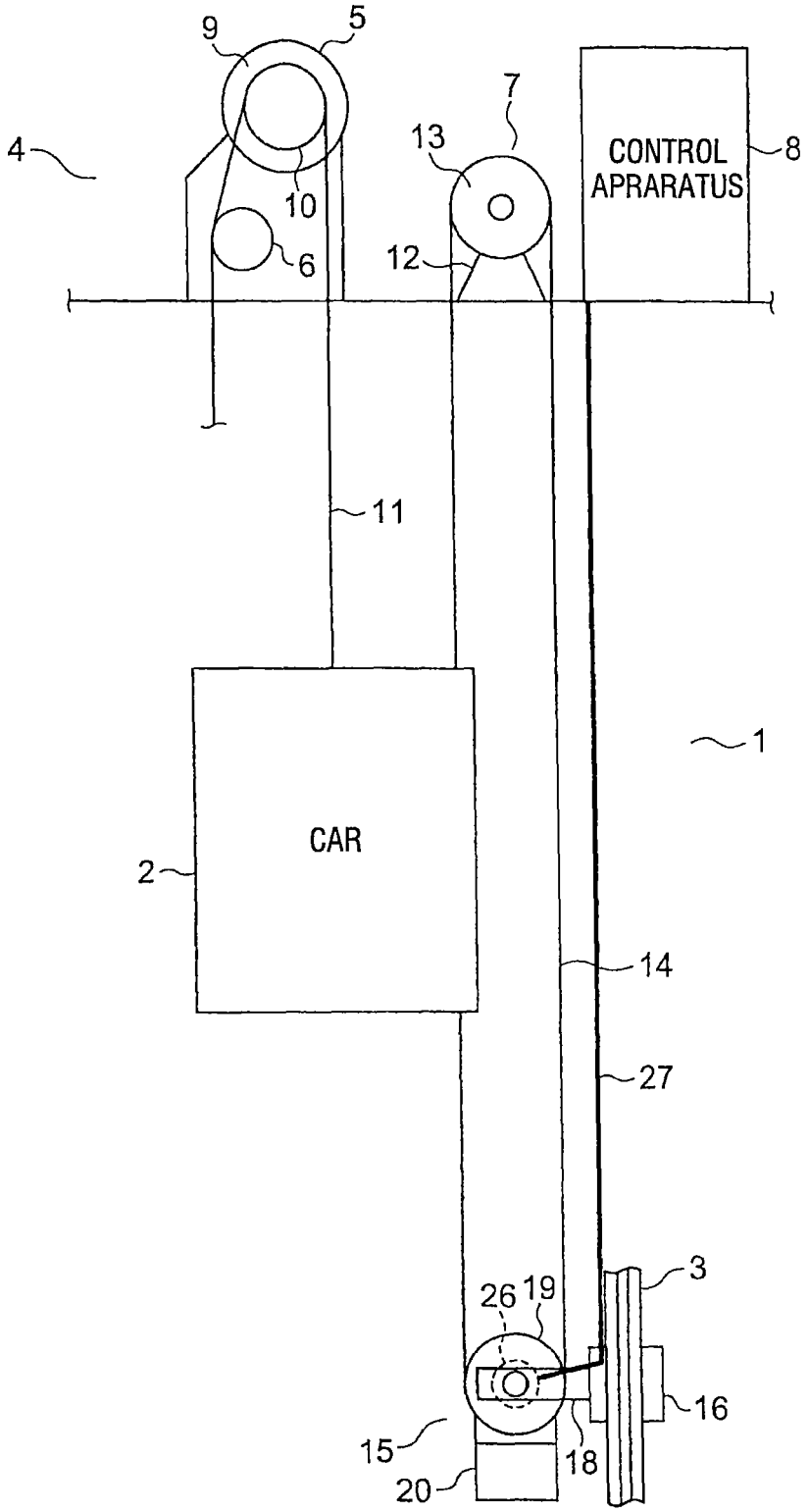
FIG. 1 is a structural diagram that shows an elevator apparatus according to Embodiment 1 of the present invention.

FIG. 1 is a structural diagram that shows an elevator apparatus according to Embodiment 1 of the present invention. In the figure, a car 2 and a counterweight (not shown) are hoistably disposed inside a hoistway 1. The car 2 is guided by a pair of car guide rails 3 that are installed inside the hoistway 1, and the counterweight is guided by a pair of counterweight guide rails (not shown) that are installed inside the hoistway 1.

A machine room 4 is disposed in an upper portion of the hoistway 1. A hoisting machine (a driving apparatus) 5 that generates a driving force that moves the car 2 and the counterweight, a deflecting sheave 6 that is disposed so as to be spaced apart from the hoisting machine 5, a speed governor 7 for stopping the car 2 upon detecting an abnormality in the speed of the car 2, and a controlling apparatus 8 that controls elevator operation are installed inside the machine room 4.

The hoisting machine 5 has: a hoisting machine main body 9 that includes a motor and a braking apparatus; and a driving sheave 10 that is rotated by the hoisting machine main body 9.

A suspending means 11 is wound around the driving sheave 10 and the deflecting sheave 6. Ropes or a belt can be used as the suspending means 11, for example. The car 2 and the counterweight are suspended inside the hoistway 1 by the suspending means 11. The car 2 and the counterweight are raised and lowered inside the hoistway 1 by the driving force from the hoisting machine 5.

Emergency stopper apparatuses (not shown) that forcibly stop movement of the car 2 are disposed on the car 2. An actuating lever is disposed on the emergency stopper apparatuses. The emergency stopper apparatuses perform an emergency operation in which the respective car guide rails 3 are gripped when the actuating lever is operated. A braking force is applied to the car 2 by the emergency stopper apparatuses performing the emergency operation.

The speed governor 7 has: a speed governor main body 12; and a speed governor sheave 13 that is rotatable relative to the speed governor main body 12.

A speed governor rope 14 is wound around the speed governor sheave 13. A first end portion and a second end portion of the speed governor rope 14 are connected to the actuating lever of the emergency stopper apparatus. The speed governor rope 14 is thereby moved in response to the movement of the car 2. The speed governor sheave 13 is also rotated in response to the movement of the car 2.

The speed governor main body 12 arrests the speed governor rope 14 if rotational speed of the speed governor sheave 13 reaches a predetermined preset overspeed. The actuating lever is operated by the speed governor rope 14 being arrested by the speed governor main body 12 when the car 2 is moving. The emergency stopper apparatuses perform the emergency operation on operation of the actuating lever. The movement of the car 2 is forcibly stopped by the emergency operation of the emergency stopper apparatuses.

A tensioning sheave apparatus 15 that applies tension to the speed governor rope 14 is disposed in a lower portion of the hoistway 1. The tensioning sheave apparatus 15 is mounted to one of the car guide rails 3.

Figure 2:
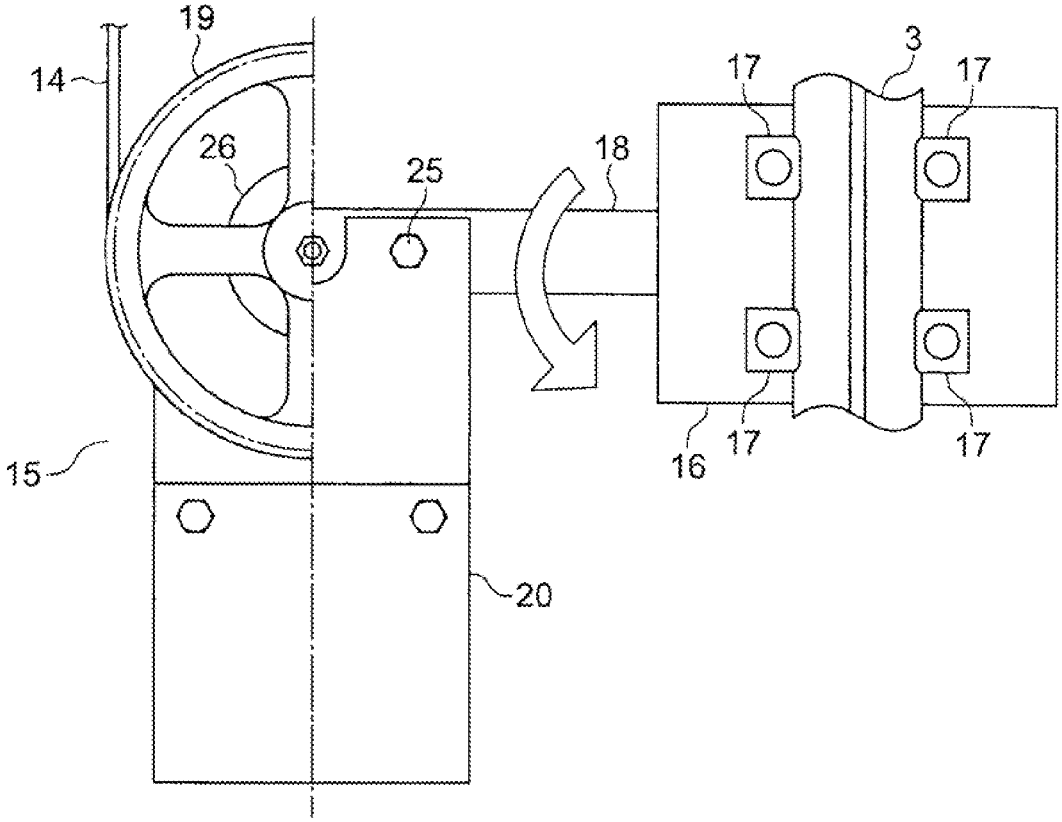
FIG. 2 is a front elevation that shows a tensioning sheave apparatus from FIG. 1.
Figure 3:
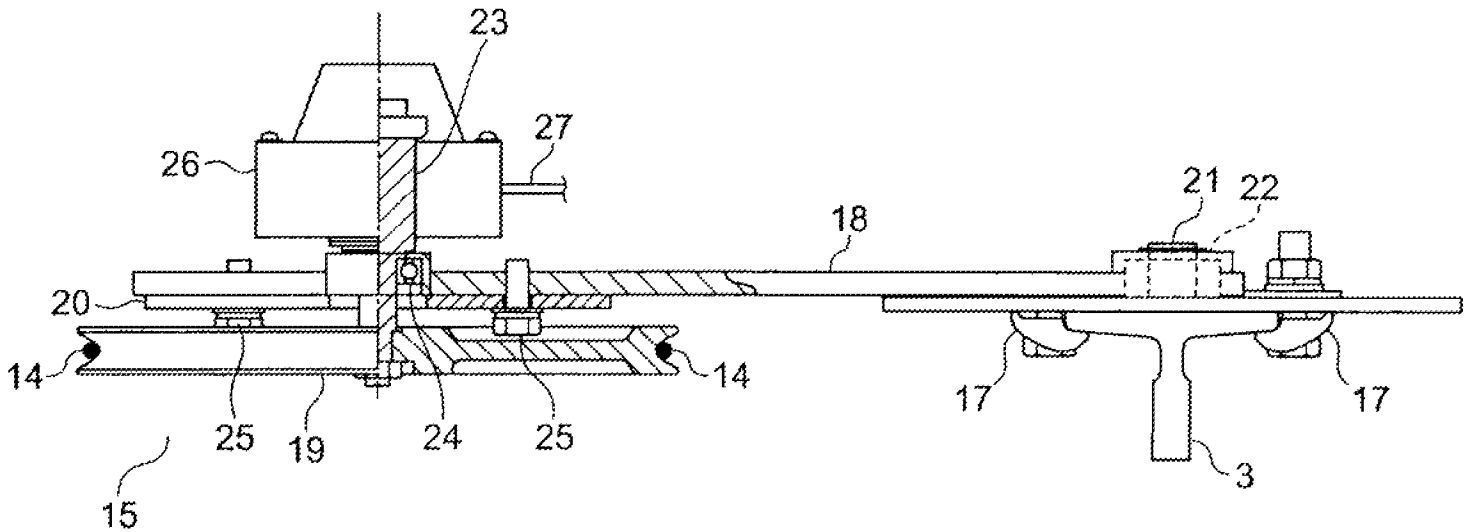
FIG. 3 is a partially cut-away top plan that shows the tensioning sheave apparatus from FIG. 2.

FIG. 2 is a front elevation that shows the tensioning sheave apparatus 15 from FIG. 1. FIG. 3 is a partially cut-away top plan that shows the tensioning sheave apparatus 15 from FIG. 2. In the figure, a mounting plate (a mounting member) 16 onto which the tensioning sheave apparatus 15 is mounted is mounted to the car guide rail 3 using a plurality of rail clips 17.

The tensioning sheave apparatus 15 has: a pivoting arm (a pivoting member) 18 that is pivotably disposed on the mounting plate 16; a tensioning sheave 19 that is disposed on the pivoting arm 18, and around which the speed governor rope 14 is wound; and a tensioning weight 20 that is disposed on the pivoting arm 18.

The pivoting arm 18 is pivotable around a horizontal shaft 21 that is disposed on the mounting plate 16 as shown in FIG. 3. A base end portion of the pivoting arm 18 is disposed on the horizontal shaft 21 so as to have a bearing 22 interposed. Consequently, a tip end portion of the pivoting arm 18 is displaced vertically by pivoting of the pivoting arm 18 that is centered around the horizontal shaft 21.

A rotating shaft 23 that is parallel to the horizontal shaft 21 is rotatably disposed on the tip end portion of the pivoting arm 18 so as to have a bearing 24 interposed. The tensioning sheave 19 is disposed on the rotating shaft 23. The tensioning sheave 19 is rotated together with the rotating shaft 23 around a shaft axis of the rotating shaft 23. The rotation of the tensioning sheave 19 is rotation in response to the movement of the speed governor rope 14.

The tensioning weight 20 is disposed on a tip end portion of the pivoting arm 18 so as to avoid the tensioning sheave 19 and the rotating shaft 23. In this example, mounting of the tensioning weight 20 onto the pivoting arm 18 is performed using bolts 25. The tensioning sheave 19 and the tensioning weight 20 are suspended by the speed governor rope 14. Tension is applied to the speed governor rope 14 by the tensioning sheave 19 and the tensioning weight 20 being suspended on the speed governor rope 14.

An encoder (a rotation detector) 26 that generates a signal in response to the rotation of the tensioning sheave 19 is disposed on the rotating shaft 23. Information from the encoder 26 is sent to the controlling apparatus 8 through a signal wire 27.

Figure 4:
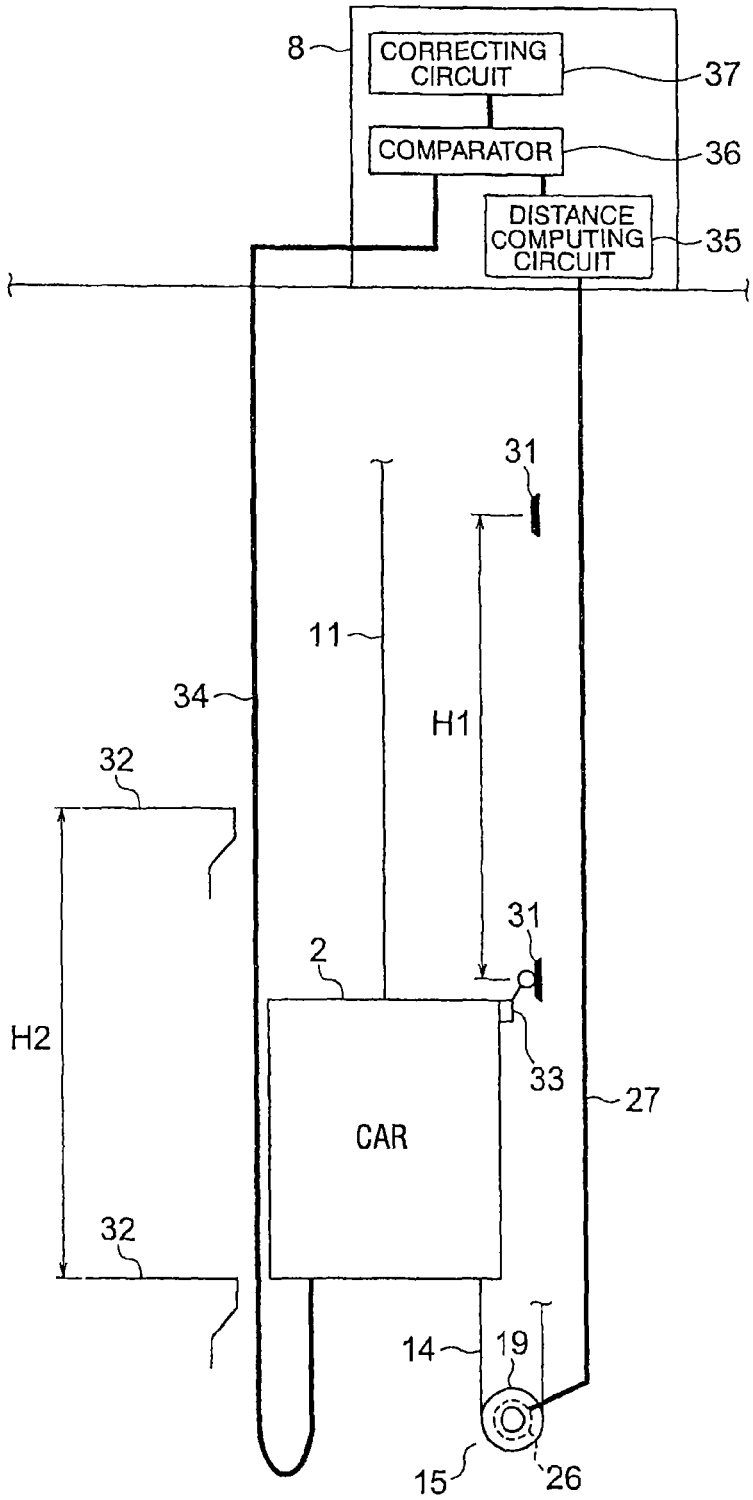
FIG. 4 is a structural diagram that shows the elevator apparatus that includes a functional configuration of a controlling apparatus from FIG. 1.

FIG. 4 is a structural diagram that shows the elevator apparatus that includes a functional configuration of a controlling apparatus from FIG. 1. In the figure, a plurality of cams (reference members) 31 are fixed inside the hoistway 1 so as to be spaced apart from each other in a direction of movement of the car 2. In this example, the respective cams 31 are disposed at positions that correspond to stopping positions of the car 2 relative to landings 32 at respective floors (predetermined positions). Consequently, a distance H1 between vertically adjacent cams 31 is identical to a distance H2 between the landings 32 of vertically adjacent floors.

A switch (a reference detector) 33 that detects the cams 31 when the car 2 is at the stopping positions of the respective building floors (i.e., positions that correspond to the positions of each of the cams 31) is disposed on the car 2. The switch 33 generates a detection signal on detecting a cam 31. In this example, the switch 33 is a contact switch that detects a cam 31 by being activated by contacting the cam 31.

A controlling cable (a moving cable) 34 is connected between the car 2 and the controlling apparatus 8. Information from the switch 33 is sent to the controlling apparatus 8 through the controlling cable 34.

The controlling apparatus 8 controls the elevator operation based on respective information from the encoder 26 and the switch 33. The controlling apparatus 8 has a distance computing circuit 35, a comparator 36, and a correcting circuit 37.

The distance computing circuit 35 calculates a distance moved by the car 2 from a reference position based on information from the encoder 26. The controlling apparatus 8 detects a position of the car 2 based on the distance moved by the car 2 that has been calculated by the distance computing circuit 35. The controlling apparatus 8 controls elevator operation based on the detected position of the car 2.

The comparator 36 determines whether or not correction of the detected position of the car 2 (i.e., the position of the car 2 that has been detected based on the information from the encoder 26) is required based on respective information from the distance computing circuit 35 and the switch 33. The determination of whether or not correction of the detected position of the car 2 is required is performed by finding the distance moved by the car 2 between two vertically adjacent cams 31 (hereinafter called "the calculated distance between floors") based on respective information from the distance computing circuit 35 and the switch 33, and comparing the found calculated distance between floors and a preset predetermined reference distance. The predetermined reference distance is set to the distance H1 between vertically adjacent cams 31.

The comparator 36 performs a determination that correction of the detected position of the car 2 is unnecessary (a normal determination) if a difference between the calculated distance between floors and the predetermined reference distance is less than or equal to a predetermined threshold value, and performs a determination that performs correction of the detected position of the car 2 (a correcting determination) if the difference between the calculated distance between floors and the reference distance exceeds the threshold value.

The correcting circuit 37 sets the position of the cam 31 detected by the switch 33 as a new reference position for the distance computing circuit 35 if a correcting determination has been performed by the comparator 36. The correcting circuit 37 corrects the reference position, which is a calculation starting point of the distance moved by the car 2. If a new reference position is set by the correcting circuit 37, the distance computing circuit 35 calculates the distance moved by the car 2 from the new reference position (i.e., the corrected reference position) based on the information from the encoder 26.

Moreover, the controlling apparatus 8 is constituted by a computer that has: an arithmetic processing portion (a CPU), a storage portion (ROM, RAM, etc.), and a signal input/output portion. The functions of the distance computing circuit 35, the comparator 36, and the correcting circuit 37 are implemented by the computer of the controlling apparatus 8.

That is, programs for implementing the functions of the distance computing circuit 35, the comparator 36, and the correcting circuit 37 are stored in the storage portion of the computer. The data processing portion executes arithmetic processing that relates to the functions of the controlling apparatus 8 based on the programs that are stored in the storage portion.

Figure 5:
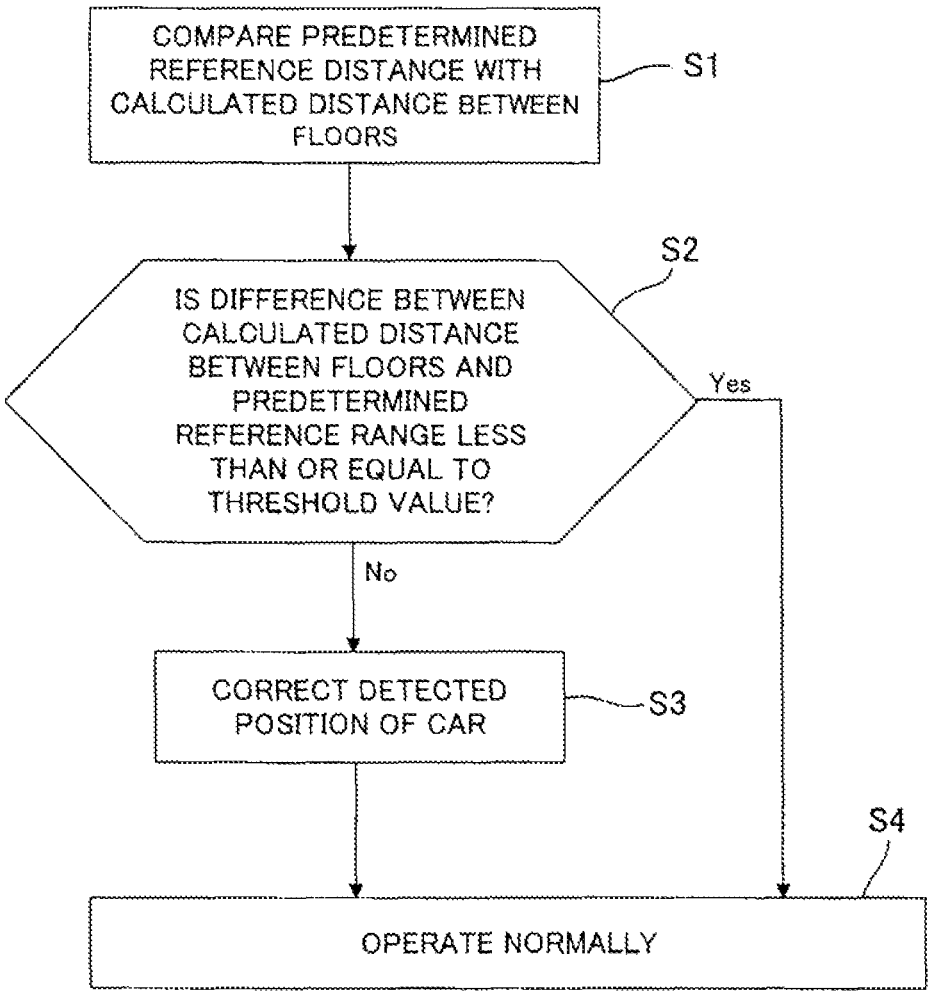
FIG. 5 is a flowchart that explains processing operations for correction of the detected position of the car in the controlling apparatus from FIG. 4.

Next, processing operations for the correction of the detected position of the car 2 in the controlling apparatus 8 will be explained. FIG. 5 is a flowchart that explains processing operations for correction of the detected position of the car 2 in the controlling apparatus 8 from FIG. 4. The calculated distance between floors that has been found based on the respective information from the encoder 26 and the switch 33 and the predetermined reference distance are compared by the comparator 36 in the controlling apparatus 8 (S1).

Next, whether or not the difference between the calculated distance between floors and the reference distance is less than or equal to the threshold value is determined by the comparator 36 (S2). If the difference between the calculated distance between floors and the reference distance is less than or equal to the threshold value, normal operation is continued without performing correction of the detected position of the car 2 (S4).

If a large slippage arises between the speed governor rope 14 and the tensioning sheave 19, for example, and the difference between the calculated distance between floors and the reference distance exceeds the threshold value, correction of the detected position of the car 2 is performed by the correcting circuit 37 based on the information from the switch 33. In other words, if the calculated distance between floors exceeds the reference distance, the position of the cam 31 detected by the switch 33 is set as a new reference position in the distance computing circuit 35 (S3). Thereafter, normal operation is performed based on the corrected detected position of the car 2 (S4).

In an elevator apparatus of this kind, because the encoder 26 is disposed on a tensioning sheave 19 that is disposed in a lower portion of the hoistway 1, a signal that corresponds to the movement of the car 2 can be issued from the encoder 26, enabling the position of the car 2 to be detected easily. When performing modification work for renewing the encoder 26, the tensioning sheave 19 can be easily removed from the speed governor rope 14 while the speed governor rope 14 remains wound around the speed governor sheave 13. Consequently, even if the tensioning sheave 19 is replaced together with renewal of the encoder 26, the tensioning sheave 19 can be easily replaced, enabling the modification work to be performed easily. Because the tensioning sheave 19 is generally inexpensive compared to the speed governor 7, cost reductions in the modification work can also be achieved.

Because the controlling apparatus 8 determines whether or not correction of the detected position of the car 2 is required based on the respective information from the encoder 26 and the switch 33, even if slippage occurs between the speed governor rope 14 and the tensioning sheave 19, for example, and the detected position of the car 2 according to the information from the encoder 26 has deviated from the actual position of the car 2, the detected position of the car 2 can be corrected to the actual position automatically. Consequently, the magnitude of deviation between the detected position of the car 2 and the actual position of the car 2 can be prevented from increasing greatly.

Embodiment 2

Figure 6:
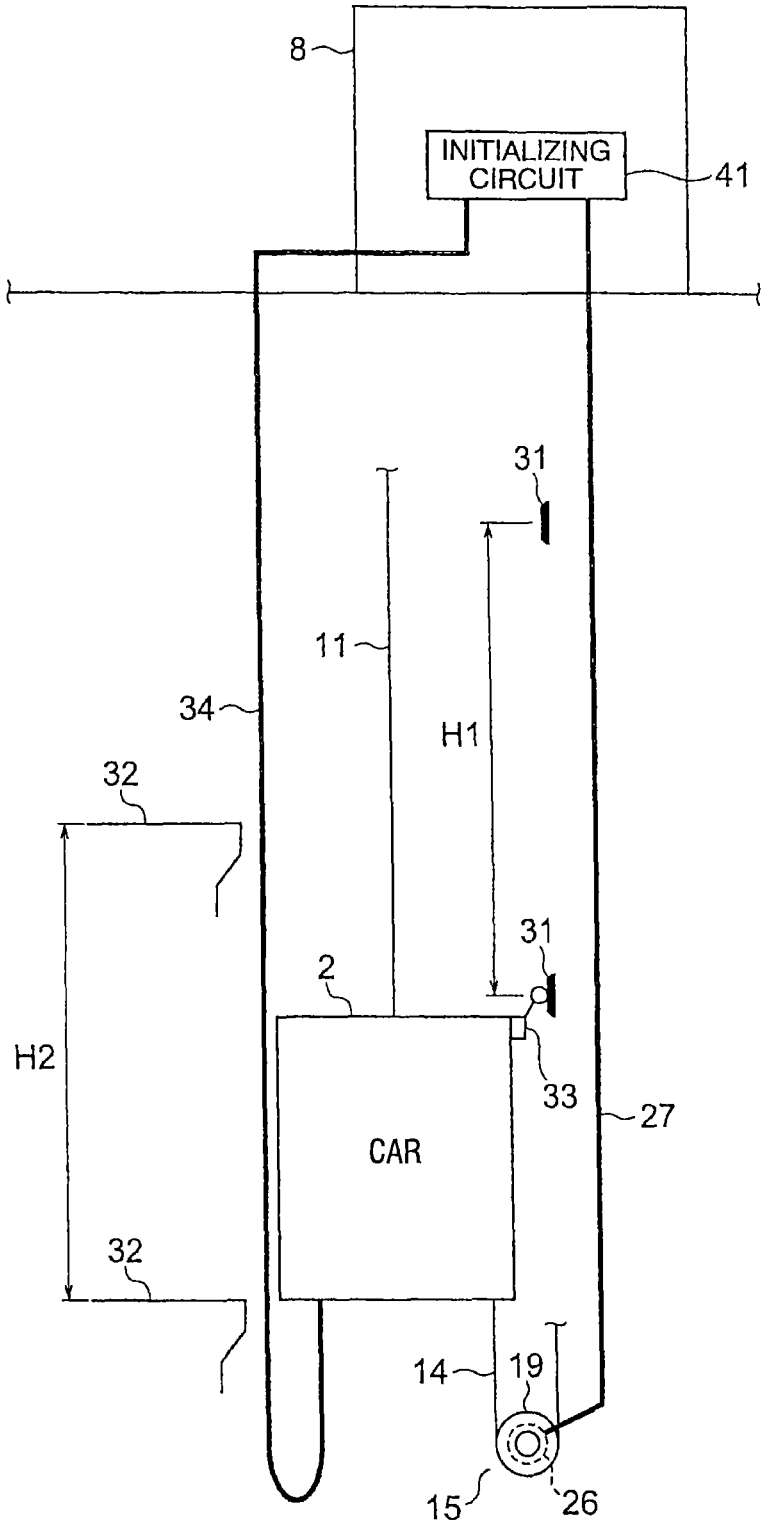
FIG. 6 is a structural diagram that shows an elevator apparatus according to Embodiment 2 of the present invention.

FIG. 6 is a structural diagram that shows an elevator apparatus according to Embodiment 2 of the present invention. In the figure, the controlling apparatus 8 further includes an initializing circuit 41. The initializing circuit 41 is able to implement initialization that associates the signal from the encoder 26 and the distance between each of the cams 31 by comparing respective information from the encoder 26 and the switch 33 while moving the car 2. The signal from the encoder 26 is a pulse signal that includes a pulse count P that corresponds to the rotation of the tensioning sheave 19.

Specifically, the initializing circuit 41 performs a setting run that moves the car 2 between the uppermost floor and the lowermost floor. During the setting run, the initializing circuit 41 detects the pulse count P from the encoder 26 from when the switch 33 detects a first of two vertically adjacent cams 31 until the switch 33 detects a second. In addition, the initializing circuit 41 calculates the distance $D_0$ moved by the car 2 per pulse of the signal from the encoder 26 (unit distance moved) based on the detected pulse count P and the preset predetermined reference distance H1 using Expression (1), and sets the unit distance moved $D_0$ as an initialized value.

$$D_0 = H1/P \tag{1}$$

The distance computing circuit 35 calculates the distance moved by the car 2 based on the initialized unit distance moved $D_0$ and the pulse count P from the encoder 26. The rest of the configuration is similar to that of Embodiment 1.

In an elevator apparatus of this kind, because an initializing circuit 41 that performs initialization that associates the signal from the encoder 26 and the distance between each of the cams 31 by comparing respective information from the encoder 26 and the switch 33 while moving the car 2 is disposed in the controlling apparatus 8, initialization for calculating the distance moved by the car 2 based on the information from the encoder 26 can be performed automatically.

Moreover, in each of the above embodiments, the cams 31 are fixed at predetermined positions in the hoistway 1, and the switch 33 is disposed on the car 2, but switches 33 may also be fixed inside the hoistway 1 at predetermined positions, and a cam 31 disposed on the car 2.

In each of the above embodiments, the switch 33 is a contact switch, but the switch 33 may also be a non-contact switch such as proximity switch, for example. A signal from a floor aligning apparatus that detects a floor alignment position of the car 2 may also be sent to the controlling apparatus 8 instead of the signal from the switch 33.

What is claimed is:

1. An elevator apparatus characterized in comprising:

a car that can be moved inside a hoistway;

a speed governor that comprises a speed governor sheave, and that is disposed in an upper portion of the hoistway;

a speed governor rope that is wound around the speed governor sheave, and that is moved in response to movement of the car;

a tensioning sheave that is disposed in a lower portion of the hoistway, around which the speed governor rope is wound, and that is rotated in response to movement of the speed governor rope;

a rotation detector that is disposed on the tensioning sheave, and that generates a signal that corresponds to rotation of the tensioning sheave; and a controlling apparatus that detects a position of the car based on information from the rotation detector.

2. An elevator apparatus according to claim 1, characterized in further comprising:

a reference member that is disposed at a first position that is either at a predetermined position inside the hoistway or on the car; and a reference detector that is disposed at a second position that is either at a predetermined position inside the hoistway or on the car, and that detects the reference member when the car is at a position that corresponds to the predetermined position, the controlling apparatus determining whether or not correction of the position of the car is required based on respective information from the rotation detector and the reference detector.

3. An elevator apparatus according to claim 2, characterized in that:

a plurality of the reference members are disposed so as to be spaced apart in a direction of movement of the car inside the hoistway; and the controlling apparatus can implement an initialization that associates the signal from the rotation detector and a distance between each of the reference members by comparing respective information from the rotation detector and the reference detector while moving the car.

* * * * *